United States Patent [19]

Ledgerwood

[11] Patent Number: 4,580,710

[45] Date of Patent: Apr. 8, 1986

[54] STOCK FEEDER WITH HYDRAULIC SHOCK ABSORBER

[75] Inventor: Harry J. Ledgerwood, Conway, Mo.

[73] Assignee: Plessey Incorporated, Melville, N.Y.

[21] Appl. No.: 667,405

[22] Filed: Nov. 5, 1984

Related U.S. Application Data

[63] Continuation of Ser. No. 406,765, Aug. 10, 1982, abandoned.

[51] Int. Cl.[4] ..... B65H 17/36

[52] U.S. Cl. ..... 226/141; 226/150; 226/162

[58] Field of Search ..... 226/141, 159, 147, 149, 226/150, 151, 136, 139, 162, 166

[56] References Cited

U.S. PATENT DOCUMENTS

| | | | |
|---|---|---|---|
| 2,721,649 | 10/1955 | Powers | 226/141 X |
| 2,929,626 | 3/1960 | Weymouth | 226/166 X |
| 2,978,160 | 4/1961 | Bunnell | 226/151 |
| 3,438,557 | 4/1969 | Lehmann | 226/162 X |
| 3,753,522 | 8/1973 | Voges | 226/150 X |
| 3,753,552 | 8/1973 | Barron | 254/172 |
| 3,877,690 | 4/1975 | Owens | 226/150 X |
| 3,937,379 | 2/1976 | Narwid et al. | 226/159 X |
| 4,051,987 | 10/1977 | Scribner | 226/159 X |
| 4,059,212 | 11/1977 | Ledgerwood | 226/141 |
| 4,076,161 | 2/1978 | Scribner | 226/151 X |
| 4,261,238 | 4/1981 | Scribner | 226/150 X |
| 4,312,469 | 1/1982 | Nilsson | 226/150 |

*Primary Examiner*—Harvey C. Hornsby

*Attorney, Agent, or Firm*—Fleit, Jacobson, Cohn & Price

[57] ABSTRACT

A stock feeder for repetitively feeding uniform segments of a continuous web of stock material from a roll to a production machine. The feeder comprises a frame, a pair of hold clamps located on the front portion of the frame, and a movable feed block which carries a pair of feed clamps that grips and pulls the stock material to a position which is held by the hold clamps. To obviate the necessity to reposition the clamps when changing the width of stock material, the frame includes first and second pairs of laterally adjustable stock roller guides located, respectively, on its front and rear portions. Also, to enable the feeder to operate faster without destruction or deterioration, and yet still attain good positioning accuracy of the stock material, the movable carriage includes a double acting hydraulic shock absorber rod which engages, respectively, at its forward and rearward stroke limits, an adjustable stud in the front portion of the frame and a fine adjustment stop bar disposed at the rearward portion of the frame. A pad of elastomer material also is used to cushion and reduce impact noise of the shock absorber.

6 Claims, 4 Drawing Figures

STOCK FEEDER WITH HYDRAULIC SHOCK ABSORBER

CROSS-REFERENCE TO RELATED PATENTS

This application is a continuation of application Ser. No. 406,765, filed Aug. 10, 1982.

This invention is related to U.S. Pat. No. 4,059,212 issued Nov. 22, 1977 entitled "Stock Feeder For Punched Stock," assigned to the assignee hereof, and being incorporated herein by reference.

BACKGROUND OF THE INVENTION

Field of the Invention

This invention relates to improvements to a stock feeder which repetitively advances uniform segments of stock material into a production machine, which in turn, performs work on the segments. Specifically, the invention relates to an improvement to the movable feed carriage of such stock feeders.

Automatic stock feeders have been used with production machinery to attain relatively high production rates of articles manufactured from stock material which is wound on a spool or a roll. To handle the material on the spool or roll, as the case may be, some conventional feeders employ at least one set of clamps to grip and pull periodically during feeding, and another set of clamps to hold the stock material in place while the production machine works on a segment of the material to form an article of manufacture. When handling relatively narrow stock material, the feeder might employ single gripper or clamp for each of the pulling and holding operations, but for relatively wide stock material, say 12 inches or more, a pair of clamp assemblies usually are used at each end of the feeder. Some of the older types of feeders employ opposed rollers, instead of clamp assemblies to perform these functions, but due to the occasional slippage which occurs between the stock material and the rollers, these types of roll feeders have not proved as efficient and reliable as grip feeders.

Production operations performed by the machine may involve forming, cutting, milling, stamping, machining, etc., and the stock material from which the article is manufactured may comprise of wire, metal tubing, sheet metal, bar steel, etc., or even non-metallic stock material such as a plastic or fiber material. The feeder itself may be constructed in a fashion to handle one particular size of stock material, or it may be adjustable over some dimension thereof to handle, for example, stock material of different dimensions. Obviously, if a production machine is to have versatility in being able to produce a variety of articles, the stock feeder which supplies it with segments of stock material should also be versatile in that it should be capable of handling material of different widths and thicknesses.

Furthermore, in order to improve the efficiency of manufacturing operations, it is desirable to operate the production machinery at high speeds in order to increase production yields and yet maintain the same quality of production without destruction or deterioration of the machine due to wear and tear. In order to attain such high operating speeds, it is required that the control functions of the feeder (i.e., the gripping, releasing, and feeding) be harmoneously controlled at synchronized time instances.

To reduce the force of impact between the movable carriage and its limit stops, U.S. Pat. No. 3,753,522 discloses a mechanical feeder for advancing uniform segments of stock material, which feeder includes in a movable feed clamp carriage, a double acting air cylinder and piston assembly which acts as a mechanical decelerator for the carriage as it comes into the proximity of the forward and rearward stroke positions of the carriage. The feed clamps and the hold clamps operate pneumatically. In its operation, the air pressure which operates pneumatic valves for the hold and feed clamps is also supplied to the double acting piston/cylinder assembly at each extreme end of the stroke for effecting mechanical deceleration of the carriage. The double acting piston couples a rod on the movable carriage and the rod engages stops located at a front portion of the frame and on an adjustable stop bar located at the rearward stroke position. The adjustable stop bar establishes the rearward position of the stroke. Each clamp assembly embodies its own separate double acting piston/cylinder assembly. This device may have limitations in the extent to which the valving operations may be synchronized with carriage movement due to the provision of separate double acting pistons and lack of adjustability of forward limit stops against which the double acting rods abut.

U.S. Pat. No. 4,059,212 assigned to the assignee hereof describes a stock feeding device, similar in some respects to the operation of the device of the subject invention, but possesses only a single feed clamp actuator and a single hold clamp actuator for feeding and holding relatively narrow stock material.

In view of the foregoing, it is an objective of this invention to provide a stock feeder which can be operated at higher speeds without attendant synchronizing problems of prior art feeders thereby to increase production yield of a production machine to which the feeder is coupled.

Another objective of this invention is to provide a stock feeder including means to more effectively profile the slowdown of the movable feed carriage at its forward and rearward limits of the stroke path thereby to enable the feeder to operate at higher speeds without losing timing synchronization between the movement of the carriage and the operation of the hold and feed clamps.

A further objective of this invention is to provide a stock feeder for automatically and repetitively feeding uniform segments of stock material, which feeder is more economical, reliable and simple in construction than prior art devices.

SUMMARY OF THE INVENTION

The foregoing objectives and advantages of this invention are attained by providing a stock feeding device comprising a frame having a front and rear portion, at least one guide rod extending between the front and rear portions of the frame, a movable feed block that is repetitively driven about the guide rods in a recipiocating manner, and a double-acting hydraulic shock absorber coupled to the movable feed block for profiling the slowdown of the movable feed block as it approaches its forward and rearward limits of the stroke position. Further, adjustable stops are provided both in the front portion of the frame and at a rear portion of the frame, against which the hydraulic shock absorber engages at its rearward and forward limits. The stops are adjustable in a longitudinal position thereby to more accurately "fine tune" the time instance (or location) in the forward and rearward stroke position at which the pneumatic valves which control the hold and feed clamps to be engaged or disengaged.

Additionally, a first pair of stock roller guides is mounted on the front portion of the frame and a second pair of stock roller guides is mounted on a rear portion of the frame thereby to establish the width of a feed path in and to guide the stock material through the stock feeder. These stock roller guides are adjustable, laterally across the feed path, to abut the edge of the stock material as it passes through the feeder. Since the stock roller guides themselves provide and establish the width of the feed path, it is not necessary to change the lateral positions of the feed and hold clamps, or the clamp carriage which supports them, to adapt the feeder to stock material of a different width. Thus, the feed and hold clamps may remain in a approximated lateral position so long as the required change in the feed path width is not a substantial change.

As with many types of stock feeding devices, the movable feed block is driven by a pneumatic actuator comprising a piston and cylinder arrangement. Limit switches disposed at the beginning and end positions of the stroke path of the feed block provide control functions for the pneumatic actuator and pneumatic valves operate the feed clamps and hold clamps in a fashion to grip, release and hold the stock material at various stages of the cyclic operation of the stock feeder.

Other advantages, features and aspects of the invention will become apparent upon review of the succeeding disclosure taken in connection with the accompanying drawings. The invention, however, is pointed out with particularity in the appended claims.

DESCRIPTION OF THE ILLUSTRATIVE EMBODIMENT

Figure 1:
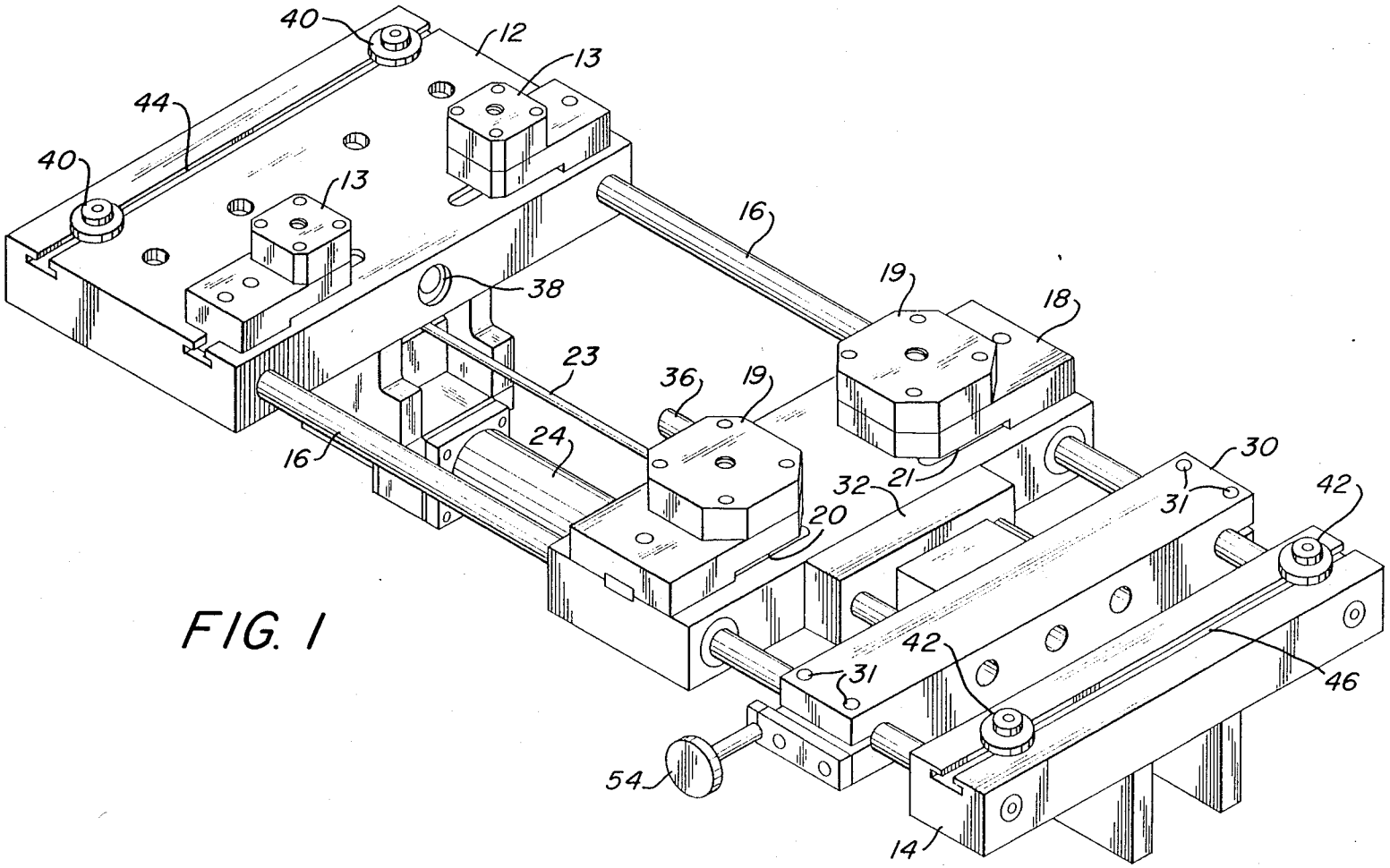
FIGS. 1 and 2 depict perspective and side views, respectively, of a stock feeder embodying the principles of the invention.
Figure 2:
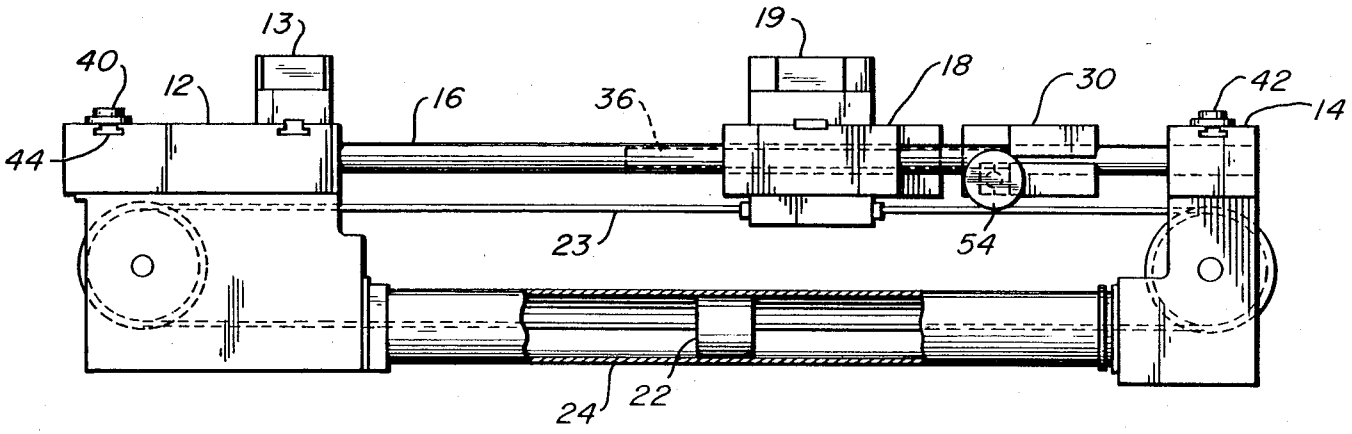

An apparatus constructed in accordance with this invention is shown in FIGS. 1 and 2 in which a frame is constituted by a front portion 12, a rear portion 14, and a pair of guide rods 16. A pair of laterally adjustable stationary hold clamps 13 are disposed on the front portion 12 of the frame. The hold clamps 13 hold in place the stock material (not shown) as it passes through a feed path over the frame. The guide rods 16 provide structural integrity of the frame by interconnecting the front and rear portions 12 and 14 as well as providing the longitudinal guide path along which the feed block 18 reciprocates.

The feed block 18 carries a pair of laterally adjustable gripper assemblies 19, which in their slots 20 include a pneumatically operated piston to clamp a sheet of stock material (not shown) thereby to pull it, upon movement of the feed block 18, toward the front portion 12 of the frame. Movement of the feed block 18 is accomplished by a pneumatic actuator assembly comprising a piston cylinder arrangement 21 and 22. To move the block 18, a cable 23 couples the piston 22 at a connecting junction 26, and its also couples the feed block 18 at a connecting junction 28. Thus, when the piston 22 is displaced by air pressure from a compressed air source applied to the cylinder 24, a force acts upon the feed block 18 through the cable 23 and thus moves the feed block 18 longitudinally along the guide rods 16. As the feed block 18 is moved in a reciprocating manner, the forward and rearward stroke positions of the feed block 18 are controlled in a conventional manner by limit switches which open and close pneumatic valves in a pneumatic circuit coupling the chambers of the cylinder 24. The actual construction and operation of the pneumatic circuit and valves are more particularly described in commonly owned U.S. Pat. No. 4,059,212, incorporated herein.

One of the limit switches is placed on the front portion 12 of the frame and another limit switch is placed on a rearward stop block 30. The stop block 30 also is slidably mounted on the guide rods 16 and establish the rearward stroke position of the feed block 18. To set the rearward stroke position of the feed block 18, bolts 31 are loosened and the stop block 30 is moved to an approximate location about the guide rod 16. Then the bolts 31 are tightened. Coupled to the stop block 30, between it and the feed block 18, is a fine adjustment bar 32 which acts as a fine adjustment for positioning the rearward stroke position of the feed block 18 with greater accuracy within, say two to three inches. The details of the fine adjustment bar will be subsequently described in greater detail.

The stock feeder also includes a hydraulic crash stop assembly located on the feed block 18 for cushioning somewhat the impact of the feed block 18 during reversal of direction at its forward and rearward stroke positions. The crash stop assembly, also being more fully subsequently described, comprises a hydraulic rod 36 located in the feed block 18 and an adjustable crash stop pad 38 mounted in the front portion 12 of the frame. In operation during its forward stroke, the hydraulic bar 36 engages the pad 38, so that as the feed block 18 approaches its forward stroke limit, its speed is reduced in anticipation of releasing the grip of feed clamps 19 on the stock material and of engaging the grip of hold clamps 13 on the stock material. On the reverse movement of the feed block 18, the other end of hydraulic rod 36 engages the fine adjustment bar 32 thereby to slow down rearward motion in anticipation of releasing the grip of hold clamps 13 on the stock material and of engaging the grip of feed clamps 19 of the stock material, and thus readies itself to repeat the feed cycle.

As an additional improvement, to reduce noise resulting from the impact between the hydraulic rod 36 and the pad 38, we have provided a polyurethane cushion on the contact surface of the front portion of the frame. Most any type of resilient material may constitute the cushion so long as it meets durability standards. The polyurethane cushion thus renders the device more quiet in its operation in compliance with noise standards for workers established by governmental agencies, such as OSHA.

Still referring to FIGS. 1 and 2, we provide two pairs of stock roller guides 40 and 42, respectively, on the front and rear portions 12 and 14 of the frame. These stock roller guides establish the width of the path of the stock material, since they abut the edges of the stock material. The roller guides 40 are slidably seated in a guide track 44 disposed on the front portion 12 of the frame, and the roller guides 42 are slidably seated in a guide track 46 disposed on the rear portion 14 of the frame. When it becomes necessary to adjust the width of the feed path, both pairs 40 and 42 of the roller guides are adjusted by loosening a bolt which secures them in a fixed position in their respective guide tracks 44 and 46. The roller guides then are manually moved against thereby to abut the edge of stock material that is placed therebetween during set up operation of the machine. Once the roller guides are in position, the bolts which secure them in the guide track are tightened to secure the roller guides in a fixed position.

Now, as can be appreciated, instead of moving the entire clamp assembly to adapt it to stock material of a different width, in our embodiment, advantageously, it is only necessary that the stock roller guides 40 and 42 be manually positioned to adjust the width of the stock feed path. As a result, it is not necessary to move the position of the feed clamps 19 on the feed block 18, or the hold clamps 13 disposed on the front portion 12, unless there are significant changes to be made in the width of the stock material feed path. Accordingly, adjusting the machine to handle stock material of a different width is a rather simple and uncomplicated procedure which quickly can be done thereby to minimize production machine down time.

Figure 3:
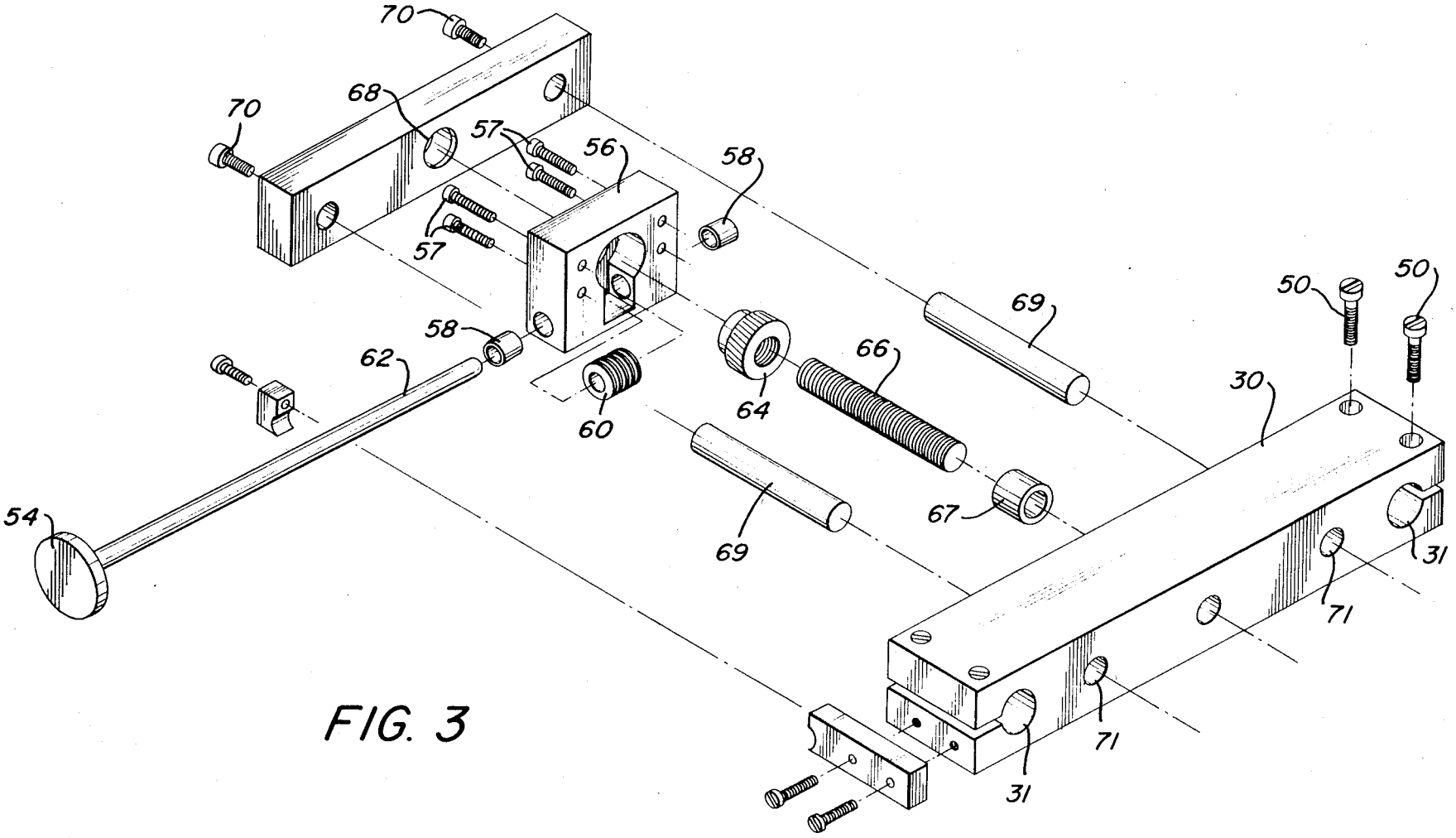
FIG. 3 depicts the fine adjustment stop bar mechanism incorporated in the apparatus of FIGS. 1 and 2.

FIG. 3 depicts in greater detail the fine adjustment bar 32 which was shown in FIG. 1, as well as an exploded view of the adjustment mechanism. As previously stated, the fine position stop bar establishes with greater accuracy the rearward stroke position of the feed block 18. As shown, the main adjustment bar 30 is supported on the guide rods 16 (not shown here) through a corresponding pair of bores 31. To adjust the longitudinal position of the adjustment bar 30, a series of bolts 31 (only two are shown) are loosened and the adjustment bar 30 is slid along the guide rod 16 to an approximate position of the rear limit of the desired stroke of the feed block 18. Once that approximate position is established, the location of the fine adjustment bar 32 is then established by a hand crank 54, which through a gearing arrangement, next described, repositions the longitudinal position of the fine adjustment bar 32 to a much finer position and with more precision.

The preferred assembly for adjusting the position of the fine adjustment bar 32 comprises a housing 56 which supports a shaft 62 in a pair of bushings 58. The shaft 62 connects to the hand crank 54 which is supported by the housing 56. The housing 56 is held against the stop block 30 by bolts 57. A worm 60 is mounted in the housing 56 and coupled to the shaft 62. A worm gear 64 in the housing 56 is meshed with the worm 60 and has its axis disposed perpendicular to and offset from the axis of the worm 60. Rotation of the shaft 62 also effects rotation of the worm 60 against the teeth of the worm gear 64 thereby to cause a fine adjustment screw 66 threaded with the worm gear 64 to be advanced or retarded, depending upon the direction of rotation of the shaft 62.

One end of the fine adjustment screw 66 protrudes through a bushing 67 into a hollow portion of the main adjustment stop bar 30, while the opposite end of the fine adjustment screw 66 abuts an inset 68 of the fine adjustment stop bar 32. A pair of alignment rods 69 couple the fine adjustment bar 32 via connecting bolts 70 so that, as the adjustment screw 66 is moved to and fro, the bar 32 is guided longitudinally in relation to the stop bar 30 in a path defined by alignment bores 71 which are journalled through the stop bar 30. Thus, by providing such an adjustment assembly, the stock feeder may be "fine tuned" to more precisely meet the desired stroke path for the feed block 18 and also more accurately synchronize the operation of the pneumatic valves with movement of the feed block 18.

Figure 4:
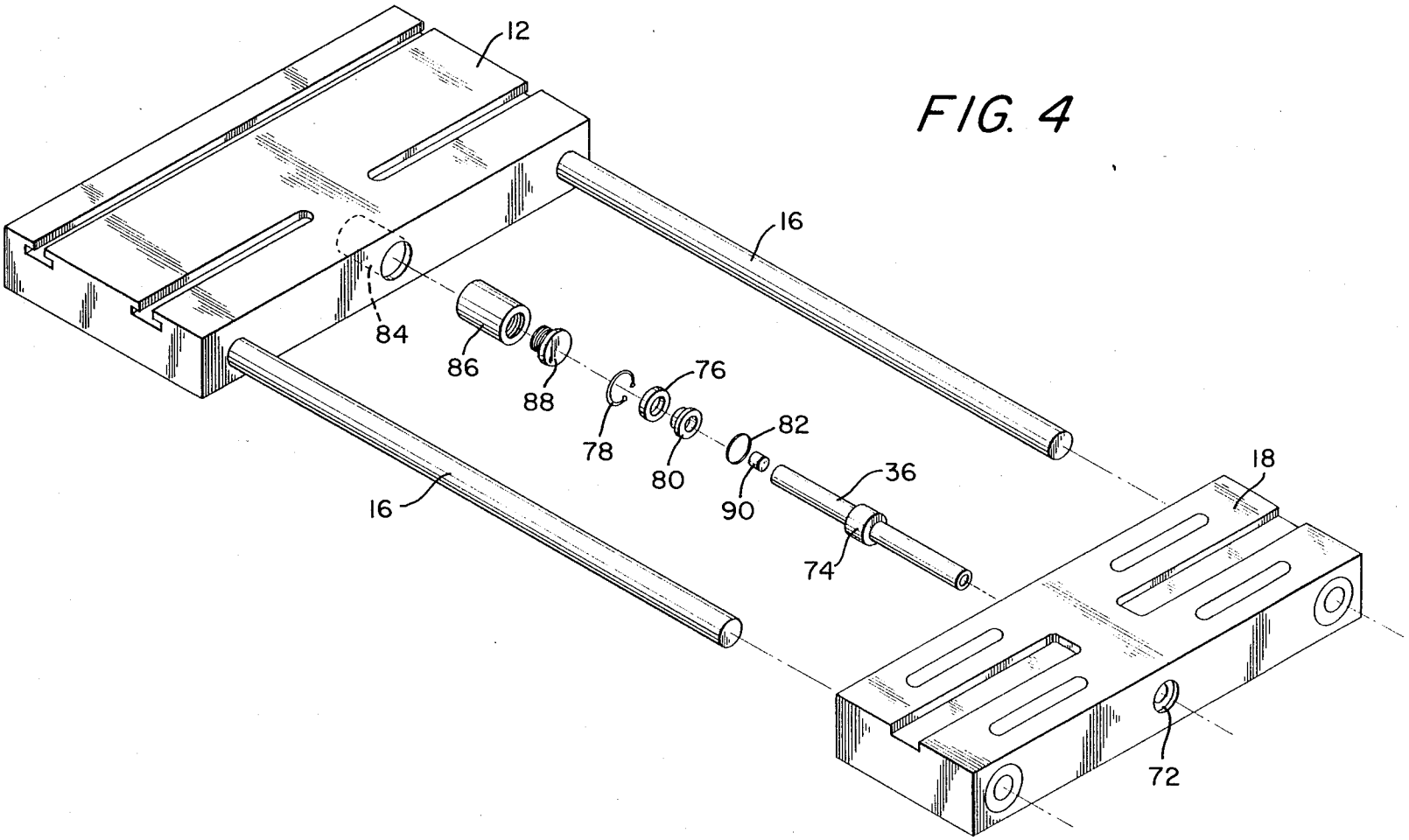
FIG. 4 depicts the hydraulic shock absorber mechanism incorporated in the apparatus of FIGS. 1 and 2.

FIG. 4 depicts an exploded perspective view of the hydraulic shock absorber rod 36 and associated components which were described briefly with reference to FIG. 1. As shown, the movable feed block 18 includes a cylinder 72 journalled therethrough for receiving the hydraulic rod 36. A piston 74 coupled to the hydraulic rod 36 coacts with the cylinder 72 to form a hydraulic shock absorber. The hydraulic rod 36 is retained in the feed block 18 by a retainer plate 76 and a lock ring 78. A seal 80 and an O-ring 82 maintains fluid in the chamber constituted by the annular space between the surface of the hydraulic rod 36 and the internal surface of the cylinder 72.

On the front portion 12 of the frame, an inset 84 receives a sleeve 86 having threads disposed on the inner surface thereof. An adjustment screw 88 is held in place by the threads inside of the sleeve 86. The location in the sleeve 86 of the screw 88 determines when the slowdown operation of the movable feed block 18 begins. Accordingly, this mechanism also provides means to "fine tune" the timing of the valving operation of the pneumatic clamps at the forward and rearward stroke limits of the feed block 18, thus permitting faster operation of the stock feeder.

To reduce the impact noise which would otherwise occur when the hydraulic rod 36 engages the surface of the adjustment screw 88, there is provided a pad of polyurethane material 90 on the end of the rod 36. Other types of impact absorbing material, such as rubber, plastics, and synthetic materials could also be used. Further, the pad 90 could, as well, be placed on the surface of the adjustment screw 88.

In operation, when the actuator drives the movable feed block 18 in a forward stroke, the hydraulic rod engages the adjustment screw 88 in the forward portion 12. Upon engagement, the feed block 18 begins to slow down due to a restrictive action caused by hydraulic fluid passing around piston 74. Upon reaching its forward limit in the stroke, the movable feed block engages limit switches (not shown) which then operates a valve assembly (also not shown) to cause reversal of the feed block 18 about its guide rods 16. The provision of the adjustment screw 88 enables the slow down of the feed block 18 and contacting of the limit switches at a time instance which can be synchronized with the valving operation to reverse the direction of the feed block 18. More accurate timing and synchronization permits the feeding apparatus to be operated at much higher speeds than would otherwise be possible. Also, it is less likely that damage would be done to the machine during high feeding rates.

Accordingly, there is provided an improved apparatus for handling material which is more versatile than prior art devices. As described, the improved feeder is more readily adaptable to stock materials of different widths and can conveniently and quickly be adjusted to minimize down time of the feeder. Further, the hydraulic rod providing a profiled slow down of the feed block at its forward and rearward position, which positions are adjustable to some extent. This adjustment helps to synchronize the contracting of the limit switches on the forward and rearward stroke positions thereby to more effectively control the valving operation of the pneumatic circuits and thus permit the machine to operate at much higher speeds.

The foregoing illustrates only an illustrative embodiment of the invention. Modifications and changes thereof can be made without departing from the true scope and spirit of the invention. That being the case, it is not our intent to limit the invention to exactly what is shown and described, but to also include these modifications and variations which may be apparent to those skilled in the art to which this subject matter pertains.

What is claimed is:

1. A material handling apparatus for repetitively advancing or feeding stock material comprising:

a. a frame having a front portion and rear portion and including a pair of laterally opposed hold clamp means mounted on said front portion and being operable for holding the stock material after advancement thereof, said hold clamp means being movable toward and away from each other to permit adjustment of the lateral spacing therebetween;

b. movable feed block means for advancing the stock material and including a pair of laterally opposed feed clamp means mounted on the feed block means for engaging stock material at the beginning of a feed cycle and for releasing the stock material after advancement thereof;

c. feed block guide means disposed between the front and rear portions of the frame for guiding the feed block means along a predetermined path;

d. drive means coupled with the frame for moving the feed block means along said feed block guide means;

e. control means for operating the drive means, the feed clamp means, and the hold clamp means, thereby to effect gripping of the stock material and movement of the stock material from a rearward position of the frame to a forward position of the frame; and f. adjustable stroke hydraulic shock absorbing means including:

(i) hydraulic speed reducing means for reducing the speed of said movable feed block means at the forward and rearward positions of the stroke path thereof, (ii) adjustable front stop means carried by said front portion of said frame for engaging said hydraulic speed reducing means, said front stop means being adjustable in the direction of movement of said feed block means to adjust the longitudinal position at which said hydraulic speed reducing means begins to reduce the speed of movement of said movable feed block means during a forward stroke thereof, and (iii) adjustable rear stop means for engaging said hydraulic speed reducing means and coupled to and extending from said rear portion of said frame toward said front portion to adjust the longitudinal position at which said hydraulic speed reducing means begins to reduce the speed of movement of said movable feed block means during a rearward stroke thereof, said rear stop means including a fine adjustment member carried by said rear portion of said frame and movable relative thereto toward and away from said front portion, and adjustment means carried by the rear portion of the frame for moving said fine adjustment member, said adjustment means including a screw thread for precisely positioning the fine adjustment member to provide the desired length of travel of the movable feed block means.

2. The material handling apparatus of claim 1, wherein said hydraulic speed reducing means comprises a piston and cylinder assembly including a rod coupled to the piston, and said front stop means comprises an adjustment screw that is adjustably mounted in the front portion of the frame at a location that is engaged by said rod.

3. The material handling apparatus of claim 2 further including a shock absorbing pad of impact absorbing material interposed between said rod and the screw, thereby to reduce the impact noise generated during operation of the material handling apparatus.

4. The material handling apparatus of claim 3 further including first and second stock material guide means on said frame for guiding stock material along the frame and for providing an adjustable width path across the frame through which the stock material passes.

5. The material handling apparatus of claim 4, wherein each of said first and second stock material guide means comprises a pair of guide elements, a guide track laterally extending across the frame, and fixing means for fixedly positioning each said guide element at a location along said guide track.

6. The material handling apparatus of claim 5 wherein said adjustment means includes a housing carried by said rear portion, a worm gear rotatably carried in said housing and having its axis of rotation parallel to the direction of movement of said fine adjusting member, a worm rotatably carried in said housing and in engagement with said worm gear, rotatable crank means connected with said worm and extending transversely outwardly of said housing, and a fine adjusting screw extending from said fine adjusting bar, said worm gear including an internal thread engageable with said fine adjusting screw for moving said screw axially upon rotation of said crank means.

* * * * *